US010594067B2

(12) United States Patent
Nittke

(10) Patent No.: US 10,594,067 B2
(45) Date of Patent: Mar. 17, 2020

(54) REFLECTOR LAMP

(71) Applicant: LEDVANCE GMBH, Garching (DE)

(72) Inventor: Andreas Nittke, Adelschlag OT Pietenfeld (DE)

(73) Assignee: LEDVANCE GMBH, Garching bei München (DE)

( * ) Notice: Subject to any disclaimer, the term of this patent is extended or adjusted under 35 U.S.C. 154(b) by 0 days.

(21) Appl. No.: 15/974,001

(22) Filed: May 8, 2018

(65) Prior Publication Data

US 2018/0261943 A1 Sep. 13, 2018

Related U.S. Application Data

(63) Continuation of application No. 14/055,991, filed on Oct. 17, 2013, now Pat. No. 10,004,134.

(30) Foreign Application Priority Data

Oct. 19, 2012 (DE) ..... 10 2012 219 135

(51) Int. Cl.

| | |
|---|---|
| ***H01R 13/15*** | (2006.01) |
| ***H01R 13/11*** | (2006.01) |
| ***H01K 1/34*** | (2006.01) |
| ***H01K 1/44*** | (2006.01) |
| ***H01K 7/02*** | (2006.01) |
| ***F21V 19/00*** | (2006.01) |
| ***H01K 1/42*** | (2006.01) |
| ***H01J 5/48*** | (2006.01) |
| ***H05H 1/28*** | (2006.01) |
| ***H05H 1/30*** | (2006.01) |
| *H01R 33/09* | (2006.01) |

(52) U.S. Cl.

CPC ..... *H01R 13/112* (2013.01); *F21V 19/00* (2013.01); *H01J 5/48* (2013.01); *H01K 1/34* (2013.01); *H01K 1/42* (2013.01); *H01K 1/44* (2013.01); *H01K 7/02* (2013.01); *H05H 1/28* (2013.01); *H05H 1/30* (2013.01); *H01R 33/09* (2013.01)

(58) Field of Classification Search

CPC ..... H01R 33/09; H01R 13/112; H01J 5/54; H01J 5/60; H01J 5/62; F21V 19/0005

USPC ..... 313/51

See application file for complete search history.

(56) References Cited

U.S. PATENT DOCUMENTS 3,950,061 A * 4/1976 Kausen ..... H01K 1/44 439/385

4,630,880 A 12/1986 Durand (Continued)

FOREIGN PATENT DOCUMENTS

| | | | |
|---|---|---|---|
| DE | 102007056270 | A1 | 5/2008 |
| EP | 0802561 | A1 | 10/1997 |
| WO | 2010052640 | A1 | 5/2010 |

*Primary Examiner* — Christopher M Raabe

(74) *Attorney, Agent, or Firm* — Hayes Soloway PC

(57) ABSTRACT

In various embodiments, a reflector lamp having a longitudinal axis is provided. The reflector lamp may include: a reflector which has a contour and a neck, with a pin base resting at the end of said neck, a light source arranged in the reflector, wherein the light source is fastened in the reflector with the aid of a mounting clip, which simultaneously adjusts the light source, wherein the mounting clip comprises three sections, namely a first section which holds the light source, a second section which serves for the adjustment in the neck and a third section which is used for the base connection.

20 Claims, 24 Drawing Sheets

(56) References Cited

U.S. PATENT DOCUMENTS

| | | | | |
|---|---|---|---|---|
| 4,894,027 | A * | 1/1990 | Brantingham | H01R 33/09 439/699.2 |
| 4,968,270 | A * | 11/1990 | Colleran | H01R 33/09 439/699.2 |
| 5,013,961 | A | 5/1991 | Reedy | |
| 5,531,613 | A | 7/1996 | Takano et al. | |
| 6,060,820 | A | 5/2000 | Noll et al. | |
| 6,075,318 | A | 6/2000 | Noll et al. | |
| 6,210,029 | B1 | 4/2001 | Noll et al. | |
| 6,461,027 | B1 | 10/2002 | Yagi et al. | |
| 6,657,369 | B1 | 12/2003 | Tamaru et al. | |
| 7,119,483 | B2 | 10/2006 | Westemeyer et al. | |
| 7,810,974 | B2 | 10/2010 | Van Rijswick et al. | |
| 2006/0187682 | A1 | 8/2006 | Goto | |
| 2008/0113523 | A1 | 3/2008 | Owen et al. | |
| 2011/0235344 | A1 | 9/2011 | Stark | |
| 2012/0120675 | A1 | 5/2012 | Cozzi | |
| 2012/0274199 | A1 | 11/2012 | Becht et al. | |
| 2014/0334184 | A1 * | 11/2014 | Yamanaka | H01R 33/09 362/657 |

* cited by examiner

REFLECTOR LAMP

CROSS-REFERENCE TO RELATED APPLICATIONS

This patent application is a Continuation of U.S. patent application Ser. No. 14/055,991, filed on Oct. 17, 2013, and titled "Reflector Lamp," which claims the benefit of and priority to German Patent Application No. 10 2012 219 135.6, filed on Oct. 19, 2012. Each of these patent applications is herein incorporated by reference in its entirety.

TECHNICAL FIELD

Various embodiments relate generally to a reflector lamp. Such reflector lamps are e.g. halogen incandescent lamps or else e.g. so-called retrofit lamps. They are envisaged e.g. for operation on a medium to high voltage (HV) of typically 80 to 250 V.

BACKGROUND

Numerous embodiments for reflector lamps in which a light source is adjusted in a reflector are known from the literature. In this case, both a halogen incandescent lamp and an LED module can act as light source; see, for example, WO 2010/052640 or U.S. Pat. No. 7,810,974 or else DE 10 2007 056 270.

In this case, an entirely glass reflector is often used, in which the centering of the light source is performed by a lamp support disk; see U.S. Pat. No. 6,210,029 and EP 802 561. Contact pins rest at the end of the reflector neck, wherein these contact pins are rotational parts consisting of brass with a lead content. During manufacture, first the contact pins are riveted in the reflector and then the power supply lines of the light source are crimped in the contact pins. The lamp has a cover disk, but this is often technically unnecessary.

SUMMARY

In various embodiments, a reflector lamp having a longitudinal axis is provided. The reflector lamp may include: a reflector which has a contour and a neck, with a pin base resting at the end of said neck, a light source arranged in the reflector, wherein the light source is fastened in the reflector with the aid of a mounting clip, which simultaneously adjusts the light source, wherein the mounting clip comprises three sections, namely a first section which holds the light source, a second section which serves for the adjustment in the neck and a third section which is used for the base connection.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

Figure 1A:
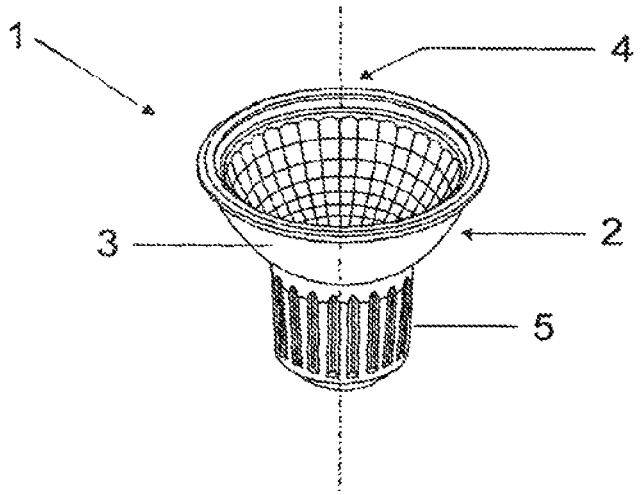
FIGS. 1A to 1F show a reflector lamp in various views, in each case without a light source.
Figure 1B:
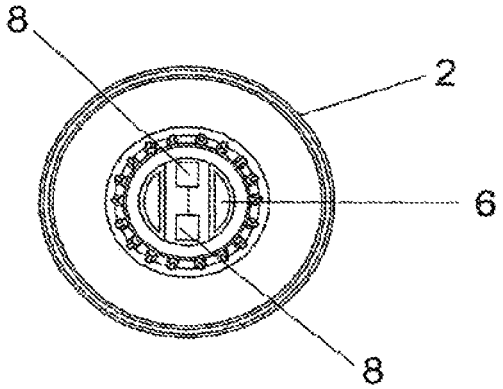
Figure 1C:
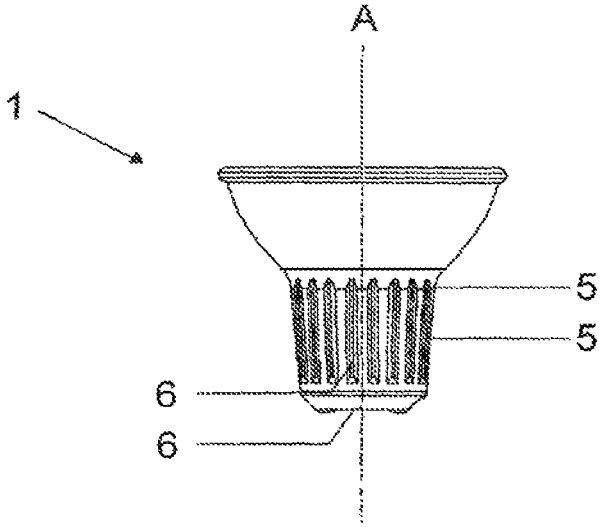
Figure 1D:
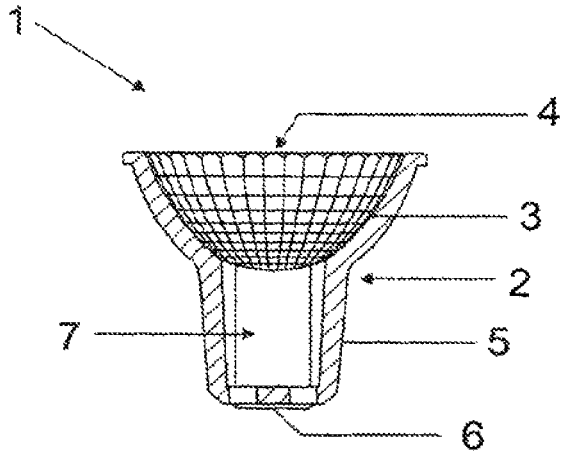
Figure 1E:
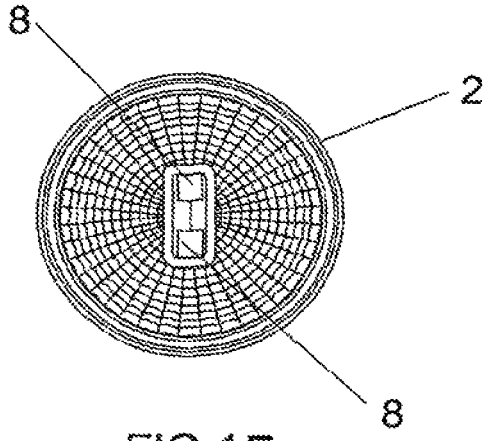
Figure 1F:
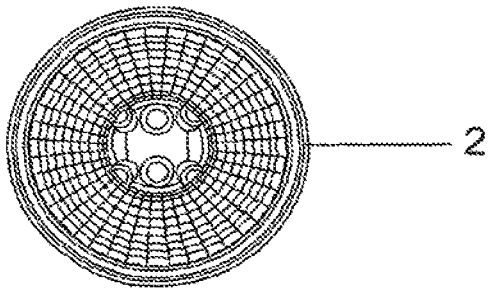
Figure 2A:
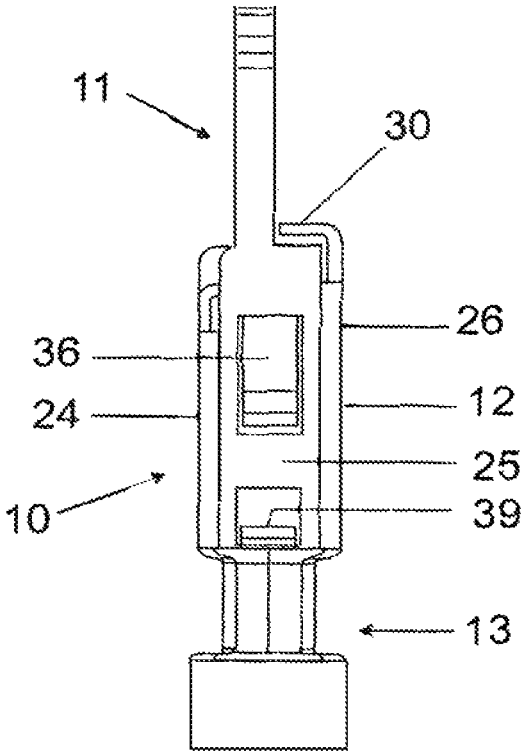
FIGS. 2A to 2E show a mounting clip for fastening the light source, in each case in various views.
Figure 2B:
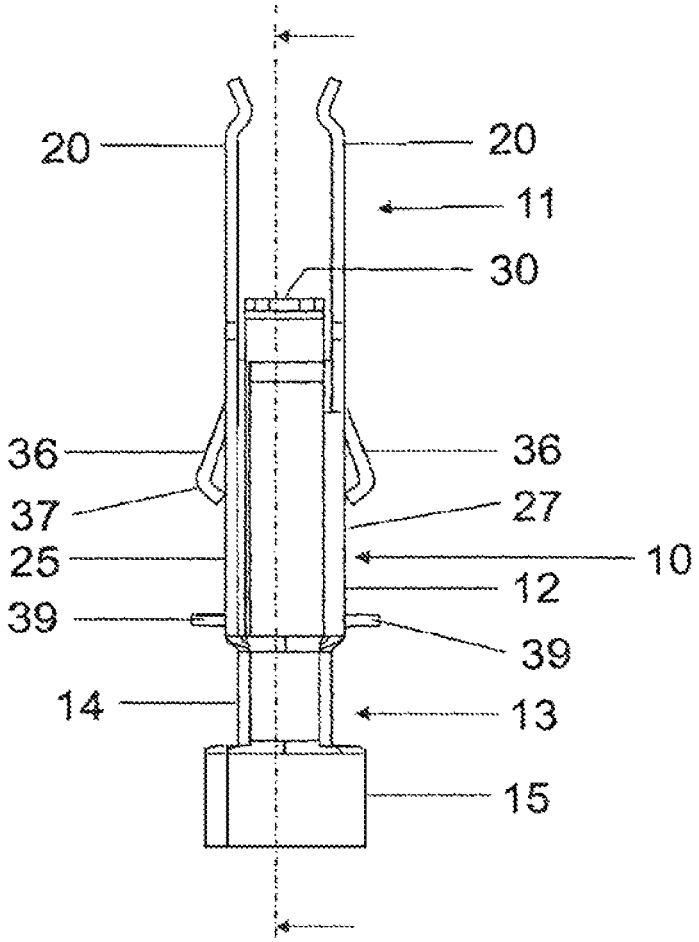
Figure 2C:
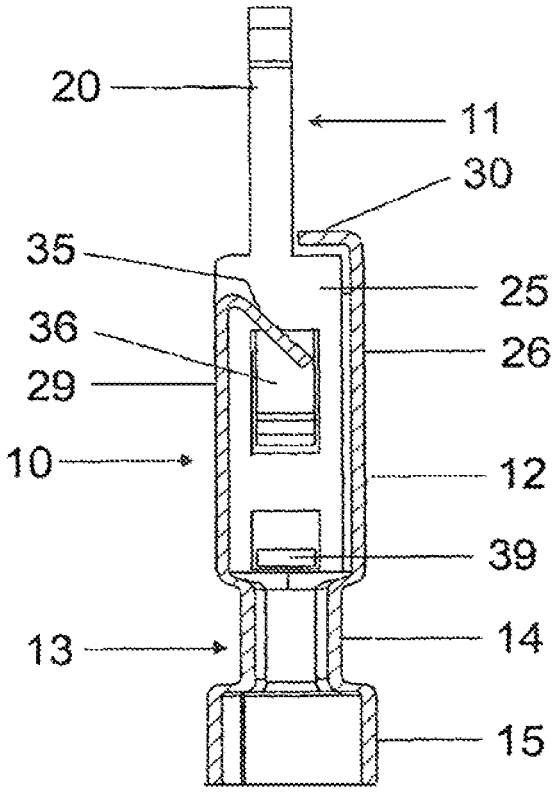
Figure 2D:
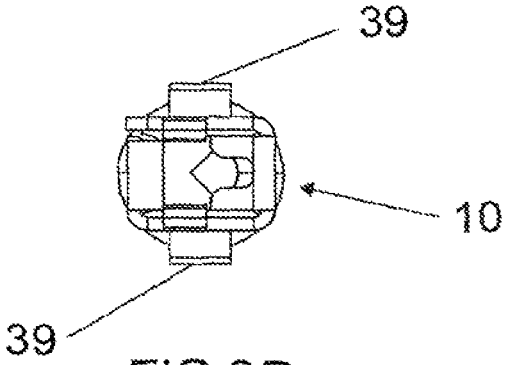
Figure 2E:
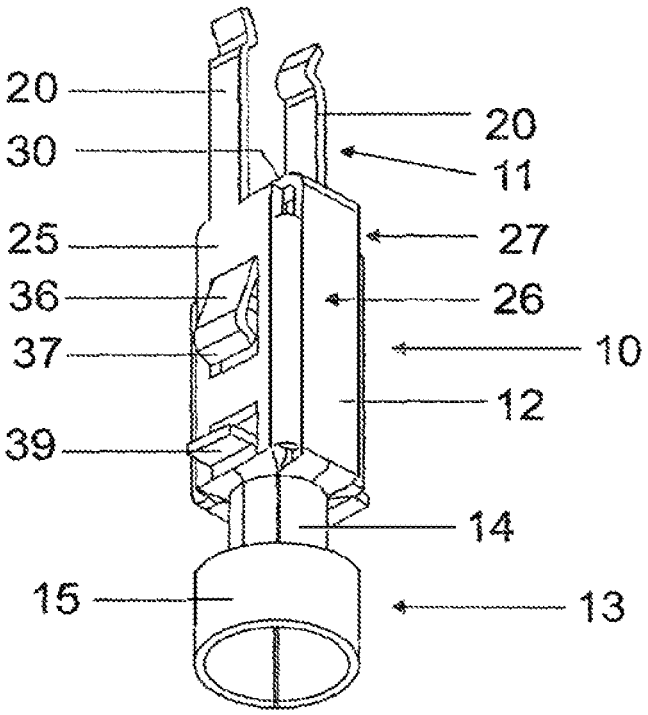

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

The word "over" used with regards to a deposited material formed "over" a side or surface, may be used herein to mean that the deposited material may be formed "directly on", e.g. in direct contact with, the implied side or surface. The word "over" used with regards to a deposited material formed "over" a side or surface, may be used herein to mean that the deposited material may be formed "indirectly on" the implied side or surface with one or more additional layers being arranged between the implied side or surface and the deposited material.

Various embodiments provide a reflector lamp with a light source which can be fitted easily.

Various embodiments relate e.g. to reflector lamps with a glass base of the type GU10 or GZ10. In this case, the fitting can be performed much more easily than previously.

In the case of such reflector lamps, the light source is often a halogen incandescent lamp or one or more light emitting diodes (LEDs) or another semiconductor component, such as a laser diode, for example.

According to various embodiments, now a special mounting clip is used, which on its own adjusts and holds the light source in the neck of the reflector. This is designed as a stamped sheet-metal part, with a first section which holds the light source, a second section which ensures the adjustment and a third section which is used for the base connection. The second section is elongate, e.g. cylindrical or e.g. constructed in columnar fashion from four side walls, wherein two opposite side walls have an extension as an arm, which extensions together form the first section, which is in the form of pincers, in order to hold the light source. While the second section is rectangular in cross section, the third section is circular in cross section, i.e. has a cylindrical configuration. In various embodiments, the third section has two parts, namely a first part with a reduced diameter in comparison with the second part. The second part in this case takes on the role of the base pin, and the first part takes on the role of the leadthrough through a bottom part at the end of the neck. The associated opening in the bottom part substantially corresponds to the cross section of the second part, i.e. it is e.g. rectangular.

In the simplest variant, the second section is cylindrical. However, no anti-rotation protection is achieved thereby, and in this case it is also complex to provide latching tabs and steadies. The columnar variant, on the other hand, ensures anti-rotation protection and latching tabs and steadies can thus easily be brought into alignment.

The second section has adjusting means, which interact with the inner wall of the neck. In various embodiments, it also has a stop, which defines the position of the mounting clip relative to the bottom part. In various embodiments, the second section also has, at its end facing the light source, a stop for the light source. In various embodiments, the second section also has, at its end facing the light source, a contact tongue for a power supply line arriving from the light source.

A cover disk can be dispensed with if the light source meets the corresponding requirements.

It is possible to position the light source with its pinch-seal edge within the reflector contour if said light source is a halogen incandescent lamp, with the result that the opening required for the pinch seal is reduced to a minimum.

It is now possible to replace the two contact pins consisting of brass and the lamp support disk with two mounting clips as stamped bent parts consisting of stainless steel.

There now results at least one aperture hole which is not rotationally symmetrical through the reflector for the mounting clips, with the result that anti-rotation protection is provided and oriented fitting is ensured. As soon as the burner has been fitted, anti-rotation protection is provided via the holding arms. The cross section which is not rotationally symmetrical therefore serves merely to fit in oriented fashion and thus supports mechanization of the fitting.

Mounting of the clip in the reflector by means of a latching tab and a depth stop for the clip is now possible.

The latching tab can be formed by a counter-bend, with the result that tolerance compensation for the fluctuating glass thickness is provided.

The degree of deformation for producing the cylindrical region in the third section is now reduced, for example with 3 mm diameter at the contact pin by virtue of longitudinal stamping, wherein 4*b=circumference of the cylindrical region with 3 mm diameter, a=circumference of the cylindrical region with a diameter of 5 mm, c=a, in each case calculated without a gap.

Advantageously, the technique of laser welding may be used in order to connect the power supply lines of the light source to the contact tongues of the clip from below through the clip.

The fastening for the light source may now be performed by virtue of the clip, with the result that the lamp support disk for centering may be dispensed with.

There is an automatic height stop for the light source on the clip. This again replaces the lamp support disk in terms of its function as a height stop.

Depending on the wall thickness and the material, it may be advantageous to also provide an inward bend on the lower edge of the third section for the purpose of increasing stability.

Depending on the material thickness and strength, it can be advantageous furthermore to weld the slots in the standardized region of the contact pin, i.e. in the first part of the third section. This is e.g. performed by means of laser welding.

In various embodiments, the fully mechanizable manufacture of a high-efficiency reflector lamp may be considerably simplified by the novel mounting clip. The advantages of the design proposed here over the prior art may consist e.g. in the following points: the mounting clip replaces the previous riveting process which is susceptible to faults, in which metal is incorporated in glass, by a simple latching connection. In addition, the crimping process is replaced by laser welding.

Finally, the brass with a lead content can be replaced by lead-free stainless steel.

The design of the mounting clip is based on manufacture as a stamped sheet-metal part from four side walls.

Various features of various embodiments in the form of an enumerated list are as follows:

1. A reflector lamp having a longitudinal axis, and having a reflector which has a contour and a neck, with a pin base resting at the end of said neck, wherein a light source is arranged in the reflector, wherein the light source is fastened in the reflector with the aid of a mounting clip, which simultaneously adjusts the light source, wherein the mounting clip comprises three sections, namely a first section which holds the light source, a second section which serves for the adjustment in the neck and a third section which is used for the base connection.

2. The reflector lamp according to proposal 1, wherein the first section has two pincer-like arms.

3. The reflector lamp according to any one of the proposals 1 or 2, wherein the second section is constructed in columnar fashion from four side walls or is shaped cylindrically.

4. The reflector lamp according to any one of the proposals 1 to 3, wherein the third section is formed cylindrically.

5. The reflector lamp according to proposal 4, wherein the third section has two parts with different diameters, wherein the part which forms the free end has the larger diameter.

6. The reflector lamp according to any one of the proposals 2 to 5, wherein the second section has outwardly projecting latching tabs on two side walls.

7. The reflector lamp according to any one of the proposals 2 to 6, wherein the second section has an outwardly projecting stop on two side walls, which stop rests on the bottom part.

8. The reflector lamp according to any one of the proposals 2 to 7, wherein a side wall of the second section has a stop at its end facing the light source, which stop is aligned as a bent-back angle transversely with the longitudinal axis.

9. The reflector lamp according to any one of the proposals 2 to 8, wherein a side wall of the second section has, at its end facing the light source, a contact tongue which is bent back as a bent-back angular piece at an angle to the longitudinal axis.

10. The reflector lamp according to any one of the proposals 1 to 9, wherein the first part of the third section has longitudinal stamped portions, which make it possible to provide the first part with a reduced diameter in comparison with the diameter of the second part, wherein it is also possible, however, for the smaller diameter to be achieved simply by longitudinal deformation.

11. The reflector lamp according to any one of the proposals 2 to 10, wherein a side wall of the second section has, at its end facing the light source, a curved spring tongue which is aligned in principle axially parallel and has a concavely bent section, the bottom of which points inwards in the direction of the first section.

An embodiment of a reflector lamp 1 is shown in FIGS. 1A to 1F. Here, the reflector 2 is first shown without a light source since this is not the critical feature.

The reflector 2 has a contour 3 which reflects the light from the light source and throws it forwards towards an opening 4. It also has a longitudinal axis A. In this case, the opening is open, but it can also be closed by a glass plate (see FIG. 7). The contour is adjoined by a neck 5. This tapers slightly towards the rear, away from the opening, and ends in a bottom plate 6, which is aligned transversely to the longitudinal axis.

Two rectangular openings 8 are arranged in mirror-symmetrical fashion with respect to the longitudinal axis A in the bottom plate 6. The two openings are not necessarily exactly the same, however, but can be slightly different in terms of their dimensions. The rectangular contour may be advantageous because it ensures anti-rotation protection and notches for fastening in the reflector emerging from planar faces are particularly simple. In a further embodiment, these openings are not precisely rectangular, but have a cylindrical central region, wherein circular openings of the reflector correspond to this. This central region is adjoined by two rectangularly configured end regions.

The cavity 7 in the neck 5 is limited to the absolutely necessary minimum, which at the same time enlarges the area of the contour, in comparison with the conventional lamp.

FIGS. 2A to 2E show various views of a novel mounting clip 10, which not only replaces the previous leadthroughs but also the centering clip which has been used to date. For this purpose, the mounting clip is designed as a stamped and bent part from stainless steel. It has substantially three sections, namely a holder section 11 facing the light source as first section. This is adjoined by a second section which acts as centering section 12 in the neck 5 and which is configured in columnar fashion with a rectangular cross section. This is adjoined by a cylindrical part, as third section 13, whose end protrudes outwards beyond the bottom plate 6 and makes electrical contact externally.

The third section is a base connection section 13; it is e.g. divided into two parts, namely a first part 14 with a relatively small diameter and a second part 15 with a relatively large diameter, which is configured in the manner of a GU10 base pin.

The holding section has two sprung arms 20, which, as pincers, can together surround the pinch seal of the bulb of a light source. In order to securely hold the bulb, it may be advantageous if this pinch seal has a double-T shape or an I shape, as is known per se, i.e. has a bead on the narrow sides of the pinch seal. In various embodiments, the pincer-like arms 20 rest on the inside in each case on a bead, with the result that alignment of the light source is ensured (see FIG. 5).

The two arms 20 are attached to two sides of the centering section 12 as an extension (these two sides are referred to below as the first side 25 and the third side 27 of the centering section), but in the process they do not reach beyond the full width of this side, but have a reduced width in comparison with this. This width is of the order of magnitude of half a width. As a result of this, a shoulder 30 which is bent back transversely with respect to the longitudinal axis can be realized as a stop for the bottom of the pinch seal by the stamped and bent part 12. This shoulder 30 is originally attached to a second side 26 of the centering section as a short extension piece and is then bent back inwards, with the result that it ends at the foot of the pincer-like arms 20 between the two arms.

The end of the fourth side 29 is also extended. This end is also bent back inwards, but has a completely different function. The bending is not provided at the level of the foot of the arms, but considerably below the foot, for example in a region of the last third of the length of the centering section. This free end is bent back inwards, to be precise not only through 90° as is the case for the stop, but considerably beyond this, with the result that it is ultimately at an angle. A reference point is an angle of approximately 135°. However, another angle can also be selected; in particular the angle is in a range of from 100 to 160°. The end is V-shaped with an opening angle of approximately 90°. The contact tongue 35 formed thereby acts as resting face for the power supply line arriving from the pinch seal of the light source, which power supply line rests there at least in punctiform fashion. This power supply line is bent back in such a way that it approximately follows the skew of the contact tongue. As a result, the two can then be connected securely easily, for example by means of laser welding.

In another embodiment, a small opening angle of the V-shaped section is provided, with said angle being approximately 30°, for example. As a result, clamping takes place and there is therefore contact which is ensured purely mechanically.

The first side 25 and the third side 27 have, approximately in their center, i.e. in the central third, in each case a latching tab 36 which serves to center in the reflector neck and protrudes outwards out of the plane of the side at a slight angle and is cut out of the flesh of the side in sprung fashion. This latching tab 36 also advantageously may have a short, oppositely directed bend 37 at its free end, which bend facilitates the insertion of the mounting clip into the reflector neck.

In the rearmost third of the centering section 12, finally the first and third sides 25, 27 may advantageously have a depth stop 39 which is bent back outwards in the form of a short tongue. This is bent back approximately transversely to the longitudinal axis. This tongue is also cut out of the flesh of the wall. This short tongue 39 ultimately rests on the inner wall of the bottom plate 6 and thus ultimately fixes the installation height of the light source, often also referred to as built-in lamp.

The first part 14 of the base connection section has a diameter which is markedly smaller than the transverse dimension of the second section. It serves the purpose of fitting the associated rectangular hole 8 in the bottom plate 6 easily. Then, the third section again widens to a second part 15 with a much larger diameter, which is of the order of magnitude of the transverse dimension of the second section. This second part 15 acts as base pin.

Figure 3:
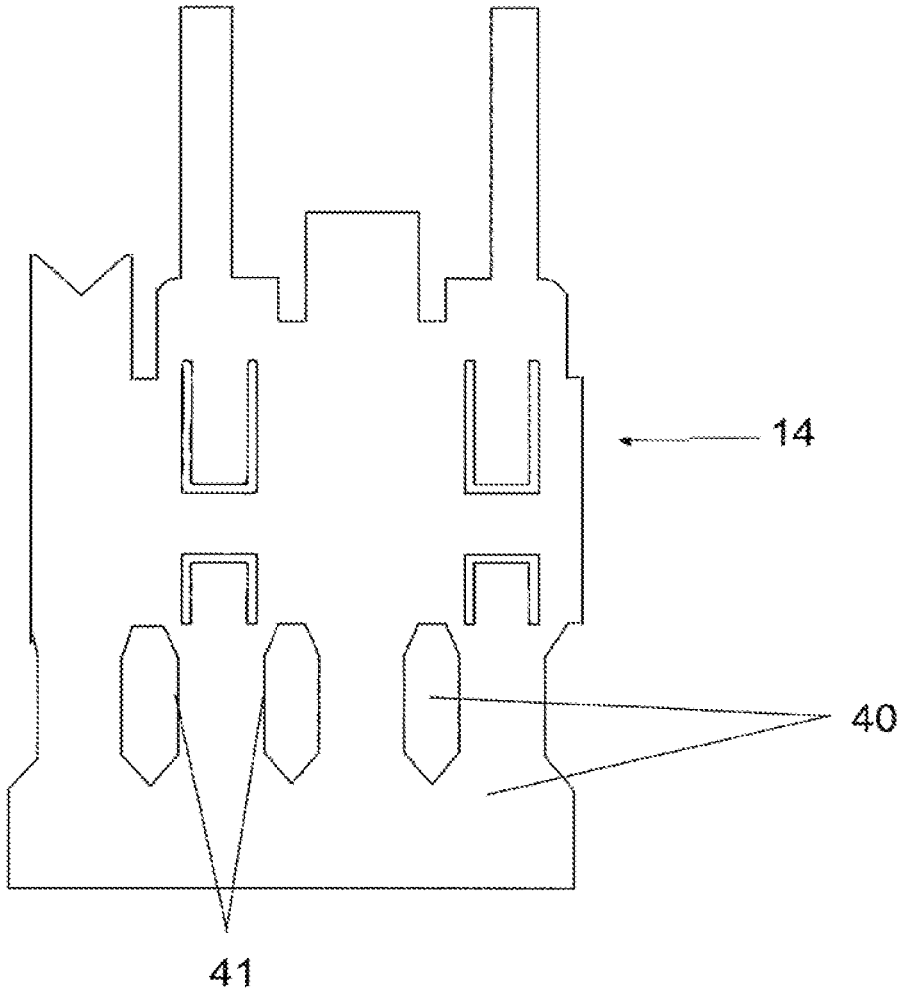
FIG. 3 shows a detail of the mounting clip.
Figure 4:
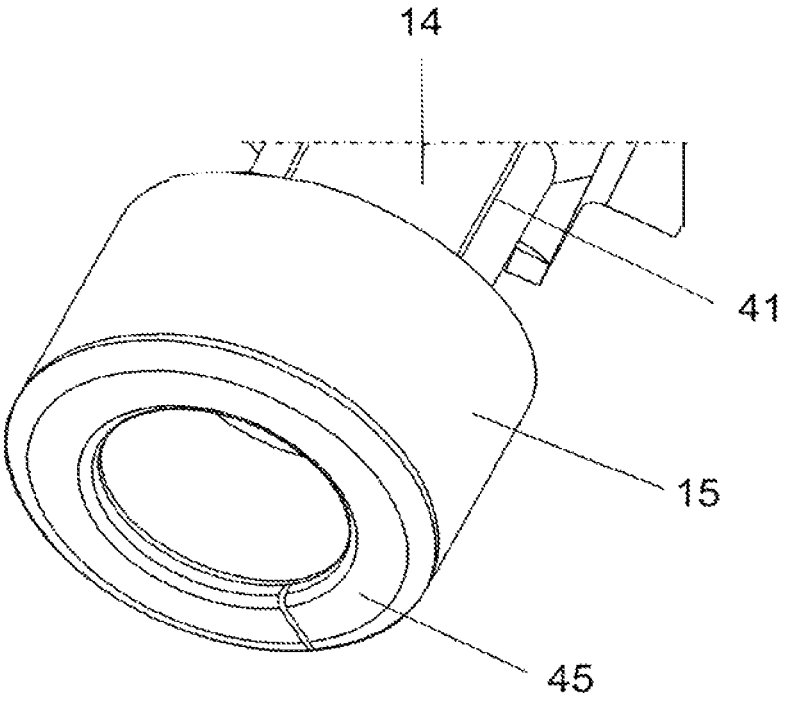
FIG. 4 shows an embodiment of the mounting clip.

According to FIG. 3, the reduced diameter of the first part 14 is realized and also stabilized by virtue of the fact that the first part has a series of longitudinal stamped portions 40 with side walls 41, which make it possible to reduce the diameter of the first part 14 (in comparison with the second part 15), wherein this region is first compressed in such a way that the side walls 41 of a stamped portion at least approximately touch one another (see FIG. 4). These slots are then preferably further stabilized by virtue of the side walls 41 being welded.

According to FIG. 4, the end of the second part 15 can be flanged inwardly, with the result that a collar 45 aligned transversely with respect to the longitudinal axis A is produced, which collar stabilizes the second part.

Figure 5:
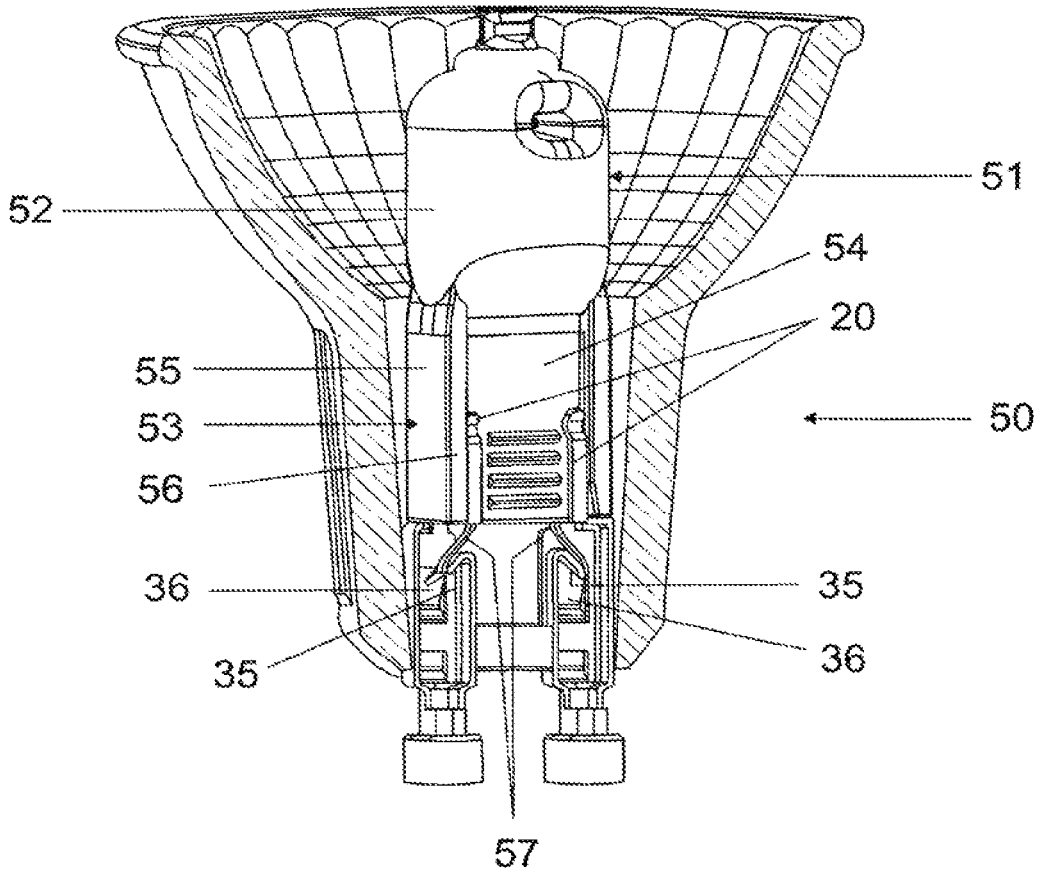
FIG. 5 shows a complete reflector lamp with a halogen incandescent lamp as light source.

FIG. 5 shows a complete reflector lamp 50, wherein the light source is in this case a halogen incandescent lamp 51, with a bulb 52, to which a pinch seal 53 is attached. This pinch seal has two broad sides 54 and two narrow sides 55. In the region of the narrow sides, in each case one bead 56 is formed, so that the pinch seal 53 has an I-shaped configuration in cross section. Two power supply lines 57 are passed outwards from the pinch seal, said power supply lines being connected to the two contact tongues 35. The pincer-shaped arms 20 engage around the pinch seal 53 on its broad sides 54, wherein the lateral rim of the arms in each case rests on the bead 56 of the pinch seal on the inside, with the result that adjustment and alignment of the bulb is ensured. The latching tabs 36 rest in the reflector neck on the inner wall thereof, with the result that, in this regard, automatic centering also takes place.

Figure 6:
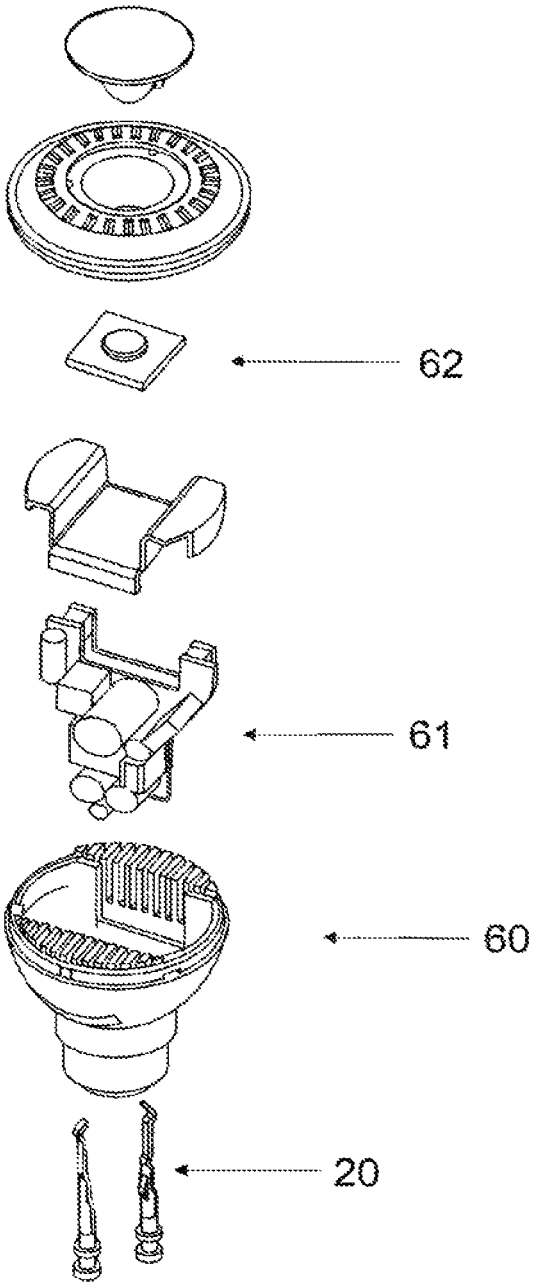
FIG. 6 shows a complete reflector lamp with an LED as light source.

FIG. 6 shows a similar reflector lamp 60, but with an LED module as light source, in an exploded illustration. Instead of the burner, in this case the printed circuit board 61 of the LED module is held. In various embodiments, the sprung arms 20 can in this case take on the contact function in order to supply current to the LED 62.

Figure 7:
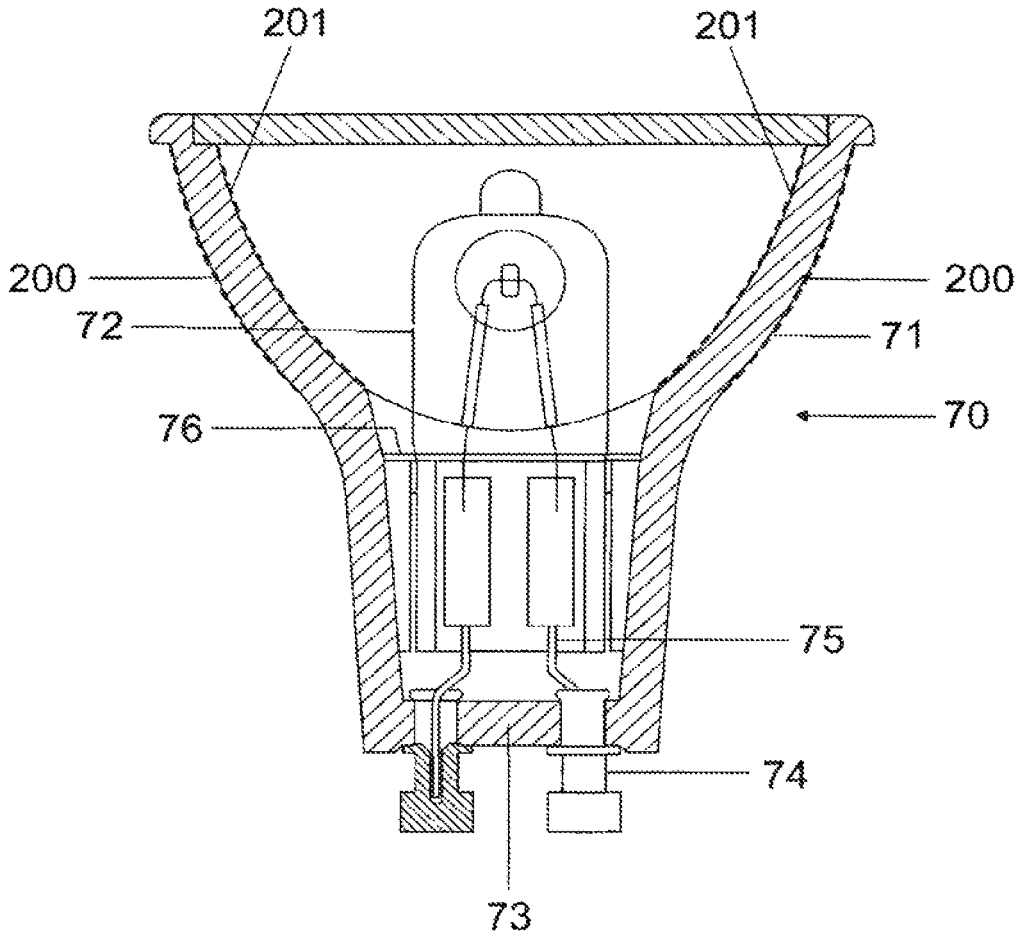
FIG. 7 shows a reflector lamp with a special design of the reflector contour.

FIG. 7 shows a reflector lamp 70 with a base of the type GU10. In this case, the reflector 71 and the light source 72 and the bottom plate 73 and the base pins 74 have a similar design to that already known; in this case the power supply lines 75 of the light source are guided directly into the sleeve-like base pins 74, and the light source itself is centered by means of a disk 76, as is already known. The novel mounting clip makes the division of the tasks into two in this way superfluous.

FIG. 7 also shows a particular embodiment of an improved reflector for a reflector lamp. In this case, increased reflectivity of the reflector and thus higher efficiency of the reflector lamp is achieved by virtue of the fact that the contour is coated on the inside with IRC or another specific layer 201, while the outer contour of the reflector is coated with aluminum (200). A suitable inner layer is generally a dichroitic layer of high quality. The outer layer 200 reflects the thermal radiation, with the result that the thermal radiation from the lamp towards the rear corresponds to that from a conventional aluminum-coated lamp. In a further embodiment, a silver coating can be used on the inside, with the result that in this case the outer aluminum coating only performs the purpose of formally adhering to standards.

In order to reduce the sensitivity of the aluminum layer to touching contact or corrosion induced thereby, a protective layer can be applied, for example. Such protective layers are known; for example TiN is used.

This measure separates the functionality of the known aluminum layer into the functionality of optical reflection and the functionality of reflection of the thermal radiation. It is thus possible to optimize the reflectivity of the optical reflection layer without taking into consideration the reflectivity in the IR range. The outer aluminum coating does not need to have a high quality since its purpose is more that of shielding than directional reflection.

Figure 8:
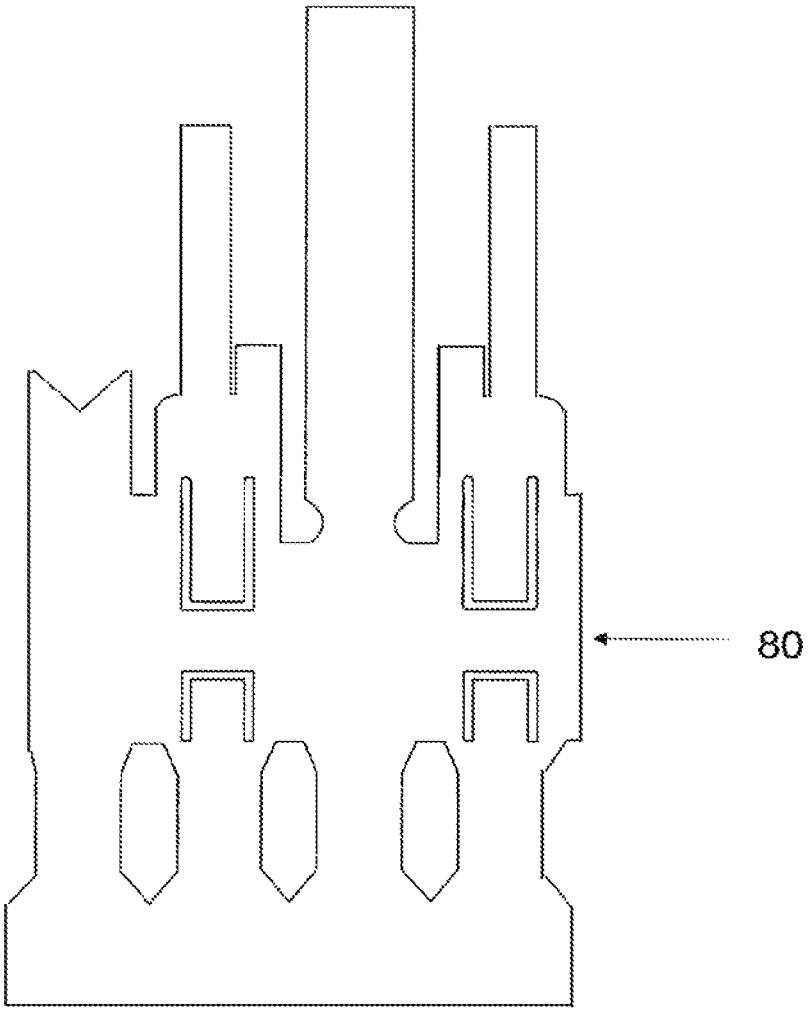
FIG. 8 shows a stamped part for the mounting clip.

FIG. 8 shows a stamped sheet-metal part 80 from which the mounting clip is produced.

Figure 9A:
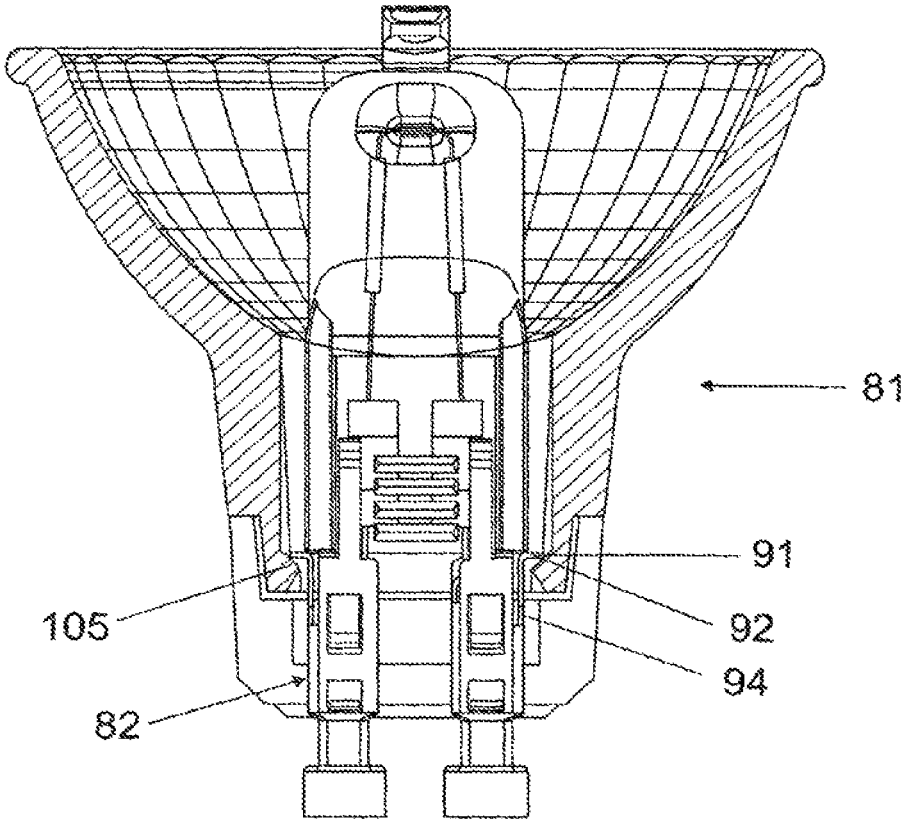
FIGS. 9A, 9B, 10A and 10B show a further embodiment of a reflector lamp.
Figure 9B:
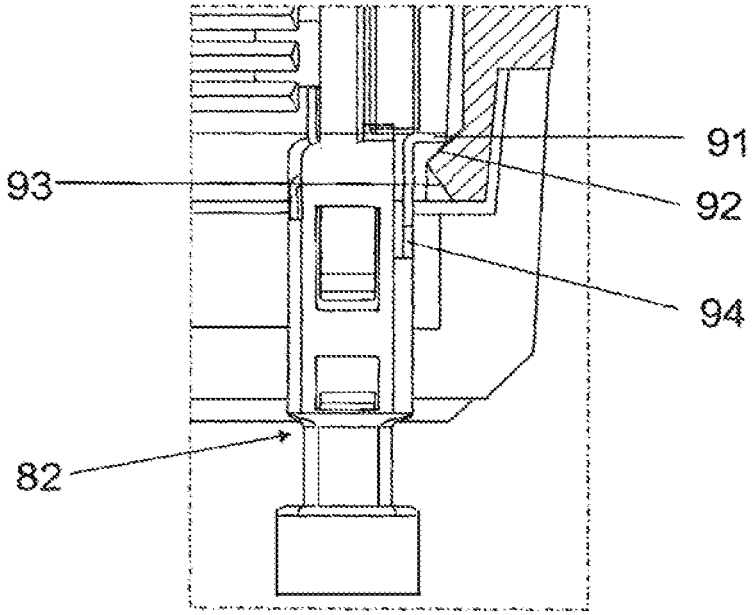

FIGS. 9A and 9B show in several views, namely overall view 9*a* and detail view 9*b*, an embodiment with a particularly preferred mounting clip 82. While the mounting clip described in the first embodiment is suitable for single-part reflectors or two-part reflectors which are already connected by means of cement, for example, the mounting clip shown here in the second embodiment is suitable for use in the case of a two-part reflector without the use of cement or an additional connecting part (holding brackets or the like), with the result that mechanized mass production is possible.

Figure 10A:
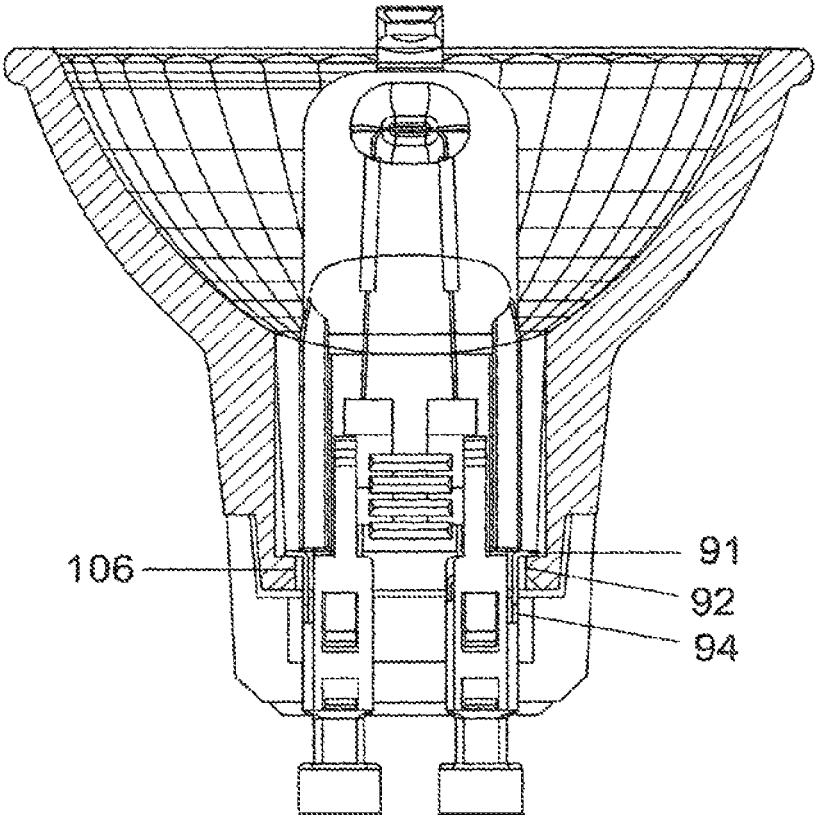
Figure 10B:
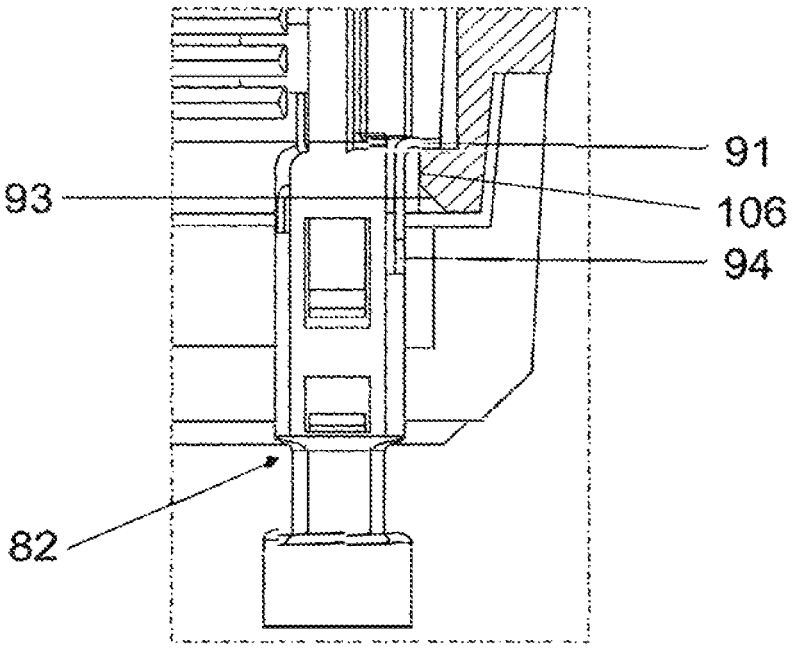
Figure 11A:
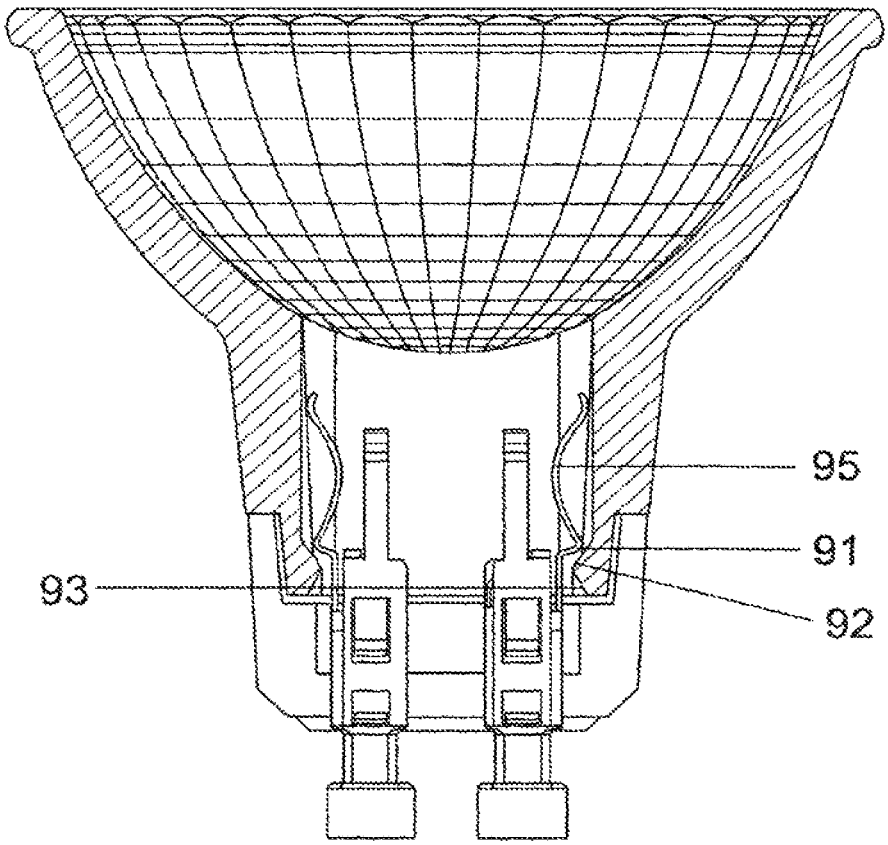
FIGS. 11A and 11B show an embodiment of a reflector lamp with a separate bottom part.
Figure 11B:
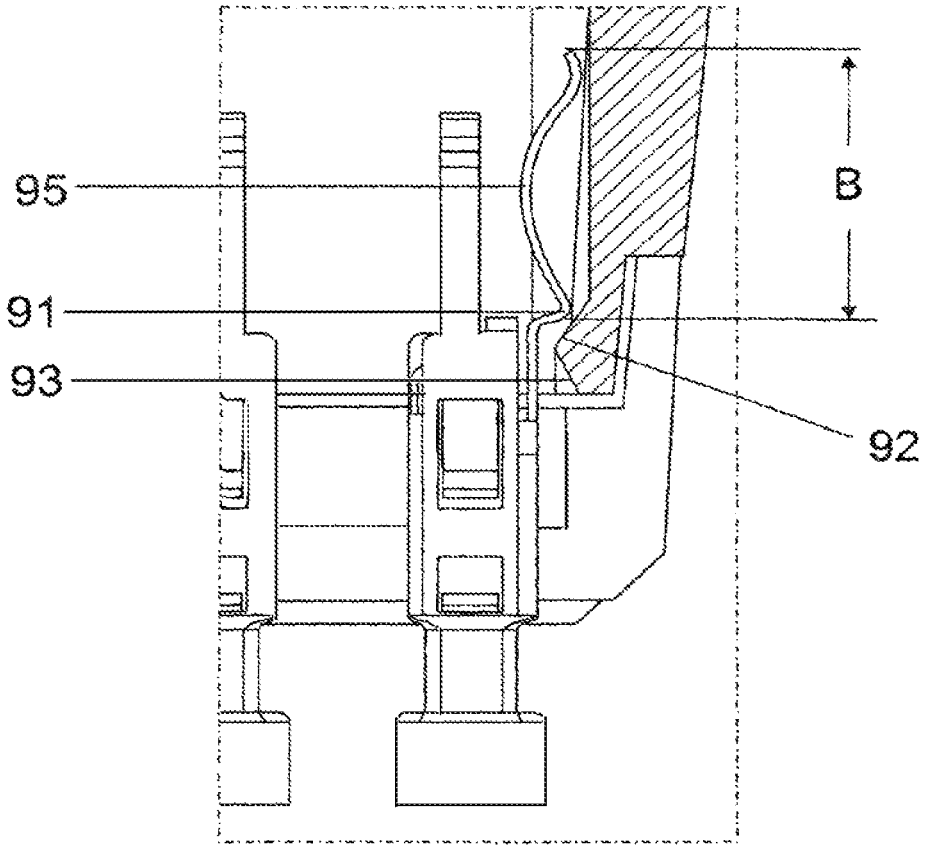
Figure 12A:
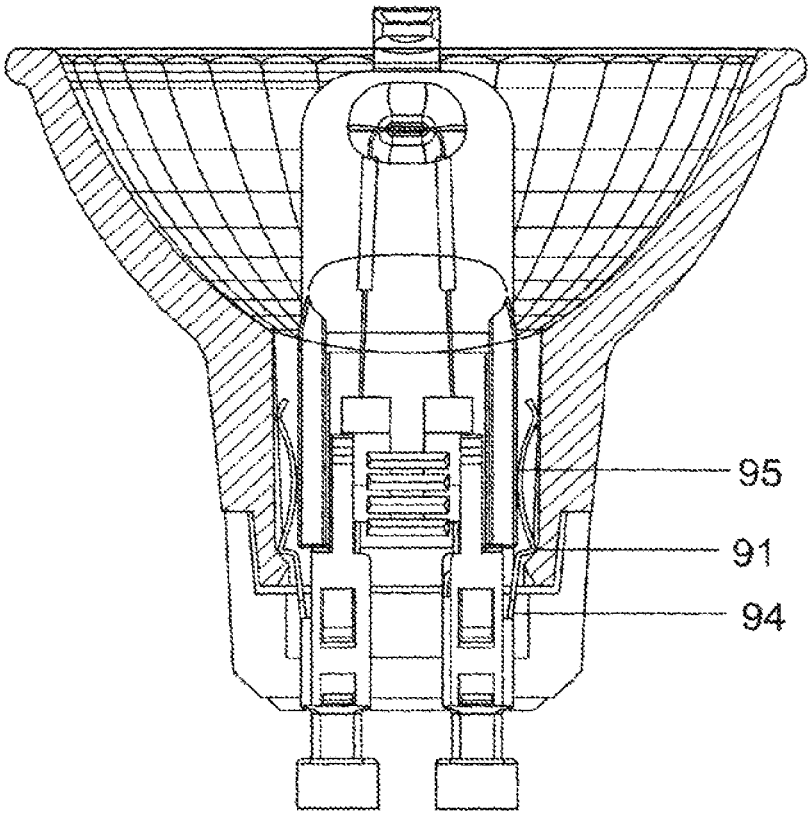
FIGS. 12A and 12B show an embodiment of a reflector lamp with a separate bottom part.
Figure 12B:
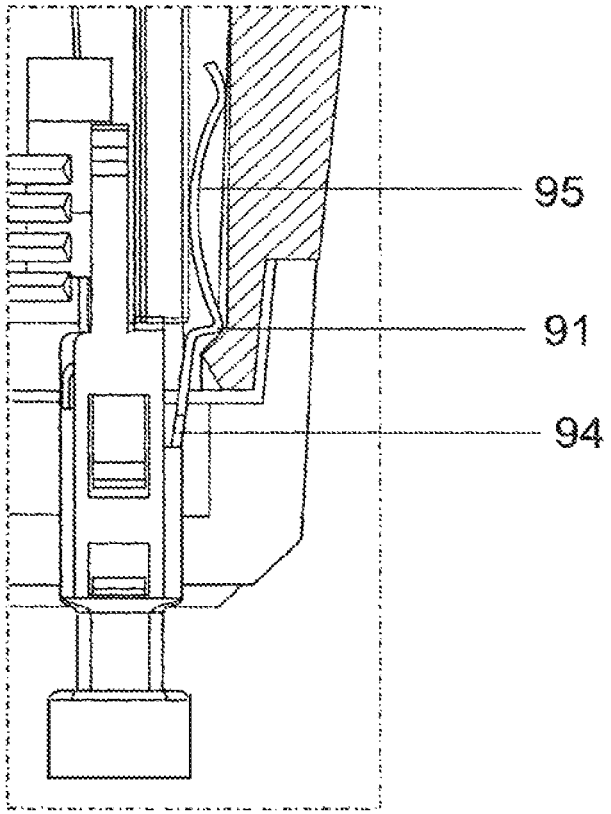
Figure 13A:
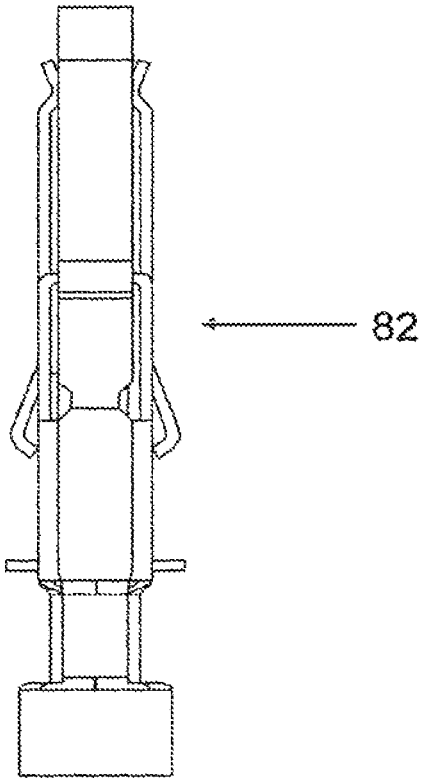
FIGS. 13A to 13E show an embodiment of a reflector lamp with a separate bottom part.
Figure 13B:
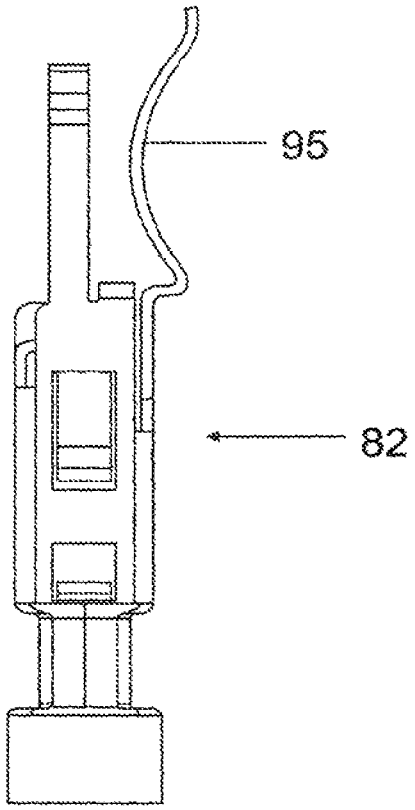
Figure 13C:
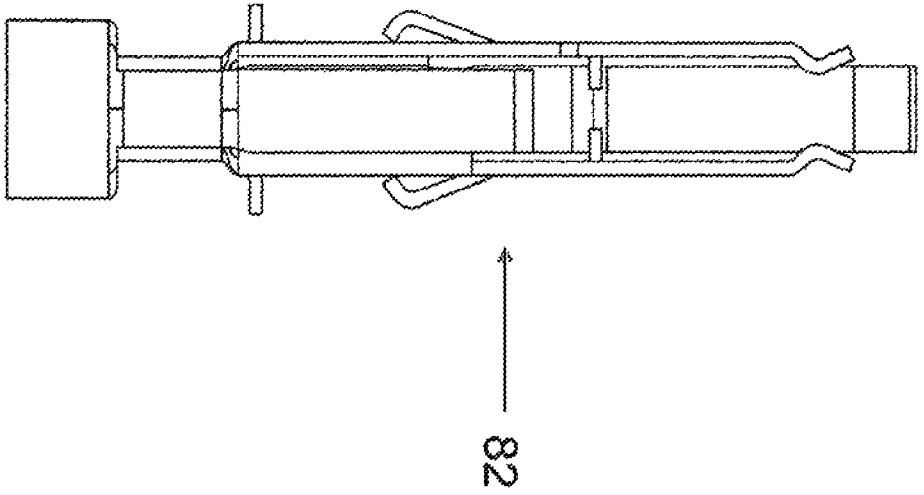
Figure 13D:
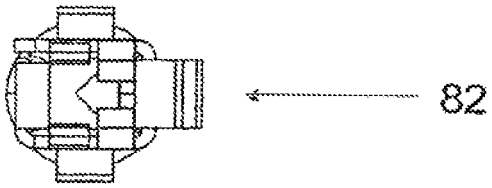
Figure 13E:
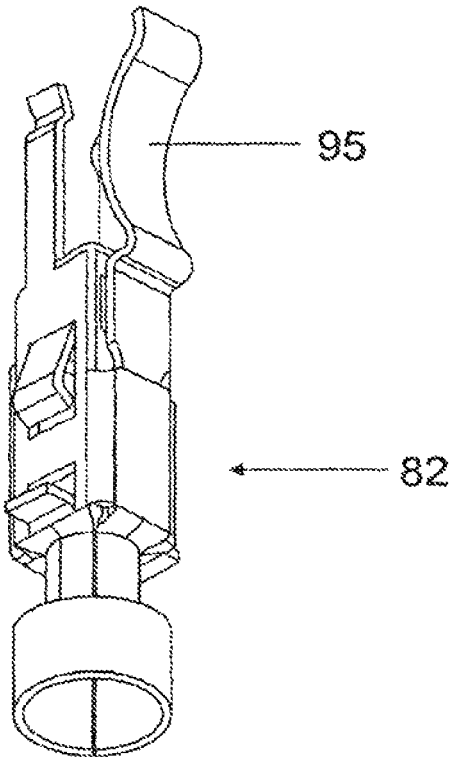

For this, a latching tab is formed on the mounting clip 82, which latching tab engages in the upper reflector part and fixes said upper reflector part (see FIGS. 9A, 9B, 10A and 10B). These two solutions are deemed to be simple, but do have disadvantages: in FIGS. 9A and 9B, in the case of an axial movement (lamp removal by the user), a force component results owing to the bevel 105, which is intended to ensure tolerance compensation. This force component can result in release of the latching. In FIGS. 10A and 10B, there is no tolerance compensation, as a result of which the connection has "play", which results in lower quality in terms of reflector properties.

The novel mounting clip 82 shown in FIGS. 11A, 11B, 12A, 12B, and 13A to 13E is in this case in principle constructed similarly to that in the first embodiment, but with the difference that a curved spring part 95 is attached in the direction towards the first part to one end of the second part. This spring part is aligned in such a way that it is tensioned when the built-in lamp is fitted. Some of the tensioning force is used to press the latching tab for fastening the upper reflector part against the bevel, which is intended to provide tolerance compensation. Thus, release of the latching connection is prevented, in contrast to FIGS. 9A and 9B. In the installed state, the curved spring part 95 is positioned between the neck or the inner wall of the neck and the pinch seal of the built-in lamp.

An advantage of the embodiment with the curvature 95 may consist in that the use of a two-part reflector, wherein a separate bottom part 111 consisting of ceramic or plastic is attached to the neck 110, which is manufactured from glass in the same way as the reflector, which separate bottom part has an attachment part 112 in the direction of the neck, can also proceed with mechanized manufacture without any additional parts and also without any cement and, in addition, "freedom from play" is thus achieved in the axial direction, i.e. a firm fit without any residual clearance.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A mounting clip configured to be operatively coupled with a light source of a reflector lamp so as to provide for adjustment of the light source in the reflector lamp, the mounting clip comprising:

a first section configured to hold the light source;

a second section configured to provide the adjustment of the light source; and a third section configured to serve as a base pin for the reflector lamp in making electrical contact for the reflector lamp;

wherein at least one of the second section and the third section is of tubular configuration.

2. The mounting clip of claim 1, wherein the first section comprises at least one pincer-like arm extending beyond an end of the mounting clip, wherein the at least one pincer-like arm is configured to interface with the light source.

3. The mounting clip of claim 2, wherein the at least one pincer-like arm is attached to at least one side of the second section.

4. The mounting clip of claim 1, wherein the second section is either:

cylindrically shaped; or constructed in columnar fashion from four side walls.

5. The mounting clip of claim 1, wherein the second section has latching tabs configured to project outwardly from the mounting clip.

6. The mounting clip of claim 1, wherein a sidewall of the second section has, at an end of the second section which faces the light source, a stop that is outwardly projecting and rests on a bottom portion of the second section.

7. The mounting clip of claim 6, wherein the stop is aligned at a bent-back angle transversely with a longitudinal axis of the reflector lamp.

8. The mounting clip of claim 1, wherein a sidewall of the second section has, at an end of the second section which faces the light source, a contact tongue configured to be electrically coupled with a power supply line for the light source.

9. The mounting clip of claim 8, wherein the contact tongue is bent back as a bent-back angular piece at an angle to a longitudinal axis of the reflector lamp.

10. The mounting clip of claim 1, wherein the second section has a shoulder formed by an extension of a side of the second section that is bent inwards.

11. The mounting clip of claim 1, wherein a sidewall of the second section has, at an end of the second section which faces the light source, a curved spring tongue that is aligned substantially axially parallel and has a concavely bent section, wherein a bottom of the curved spring tongue points inward in a direction of the first section.

12. The mounting clip of claim 1, wherein the third section is cylindrically shaped.

13. The mounting clip of claim 1, wherein the third section comprises:

a first portion; and a second portion of greater diameter than the first portion.

14. The mounting clip of claim 13, wherein the second portion forms a free end of the third section.

15. The mounting clip of claim 13, wherein:

the first portion is configured to serve as a lead-through at an end of the reflector lamp; and the second portion is configured to serve as the base pin for the reflector lamp.

16. The mounting clip of claim 13, wherein the first portion has longitudinal stamped portions that make it possible to provide the first portion with a lesser diameter in comparison with the second portion, yet also possible for the lesser diameter to be achieved by longitudinal deformation.

17. The mounting clip of claim 1, further comprising at least one curved spring part attached to an end of the second portion in a direction towards the first portion such that the at least one curved spring part is tensioned when the light source is fitted in the reflector lamp.

18. The mounting clip of claim 17, wherein the at least one curved spring part is configured to be disposed between a neck or an inner wall of the neck and a portion of the light source.

19. The mounting clip of claim 1, wherein:

the first section comprises two pincer-like arms extending beyond an end of the mounting clip, wherein the two pincer-like arms are configured to interface with opposing sides of the light source;

the second section is of tubular configuration and is either cylindrically shaped or constructed in columnar fashion from four side walls; and the third section is of tubular configuration and is cylindrically shaped.

20. A reflector lamp comprising the mounting clip of claim 1.

* * * * *